United States Patent [19]

Martinez

[11] Patent Number: 4,461,472

[45] Date of Patent: Jul. 24, 1984

[54] EXERCISE DEVICE BENEFICIAL TO THE METATARSAL ARCH

[76] Inventor: Rosendo Martinez, 790 Prigge Rd., St. Louis, Mo. 63138

[21] Appl. No.: 438,274

[22] Filed: Dec. 27, 1982

[51] Int. Cl.[3] ..... A01B 23/04

[52] U.S. Cl. ..... 272/96; 272/141

[58] Field of Search ..... 272/96, 67, 141, 139, 272/135, 136, 137, 138; 128/25 B, 25 R

[56] References Cited

U.S. PATENT DOCUMENTS

| | | | |
|---|---|---|---|
| 1,911,390 | 5/1933 | Pullman | 272/96 |
| 2,230,890 | 2/1941 | McClenathen | 272/96 |
| 2,250,493 | 7/1941 | Milne | 272/96 |
| 4,239,212 | 12/1980 | Hickey | 272/141 |

FOREIGN PATENT DOCUMENTS

| | | | |
|---|---|---|---|
| 2001557 | 7/1971 | Fed. Rep. of Germany | 272/96 |

*Primary Examiner*—Richard J. Johnson

[57] ABSTRACT

The present invention relates to exercising devices for the feet, specifically for the metatarsal arch, beneficial for the flexibility and strength of the feet and for the Morton's toe. The exercising device consists of a housing wherein a sliding device guided by a guiding rod and spring loaded against said housing is capable of producing a resistance against the flexing of the foot's metatarsal arch.

1 Claim, 2 Drawing Figures

EXERCISE DEVICE BENEFICIAL TO THE METATARSAL ARCH

BACKGROUND OF THE INVENTION

Conventional techniques for exercising the metatarsal arch have apparently fallen short of that needed as a result of the tremendous increase in the number of persons running and jogging which in turn has created a large amount of foot injuries and in turn has created a demand sufficiently large to attract considerable attention to the design of exercise devices to relieve discomforts. Heretofore people exercised the metatarsal arch with a method known as building mounds. This is done by sitting on a bench with a towel folded lengthwise on top of a smooth surface, foot directly under the knees, toes placed at one end of the towel, a dead weight at the other end of the towel and gripping the towel with the toes, pulling toward the body, building a mound with the towel. Heels remain firmly on the floor during the exercise and the pull of the towel should be made to the maximum toe flexion. When too much towel is under the arch the exercise is stopped and the towel and weight are moved back to the original position to start again. With my new invention it is not necessary to have a smooth surface for the exercise and the exercise can be continued indefinitely without any interruptions and it is not as cumbersome.

SUMMARY

It is therefore an object of the present invention to provide a convenient metatarsal arch exerciser made of four parts: a housing, a sliding device, a guiding rod and a spring.

Said housing is capable of resting on a firm surface, support a human heel at one end and support a spring loaded sliding device at the other end. Said sliding device is guided by a guiding rod, is capable of being gripped by human toes and as a human metatarsal arch is flexed opposing reactions between said human toes and the force at the heel will cause said sliding device to slide over said housing and over said guiding rod toward said human heel compressing said spring between said sliding device and said housing. Said spring will develope sufficient resistance to make the flexing of said metatarsal arch strenuous, developing flexibility and strength of said metatarsal arch. Said sliding device is capable of returning to its original position by the stored energy of said spring as the flexion of said metatarsal arch is relaxed.

An object of the present invention is to provide a device which allows the user to exercise the metatarsal arch with a continued uninterrupted movement in a very convenient manner.

DETAILED DESCRIPTION OF THE INVENTION

Figure 1:
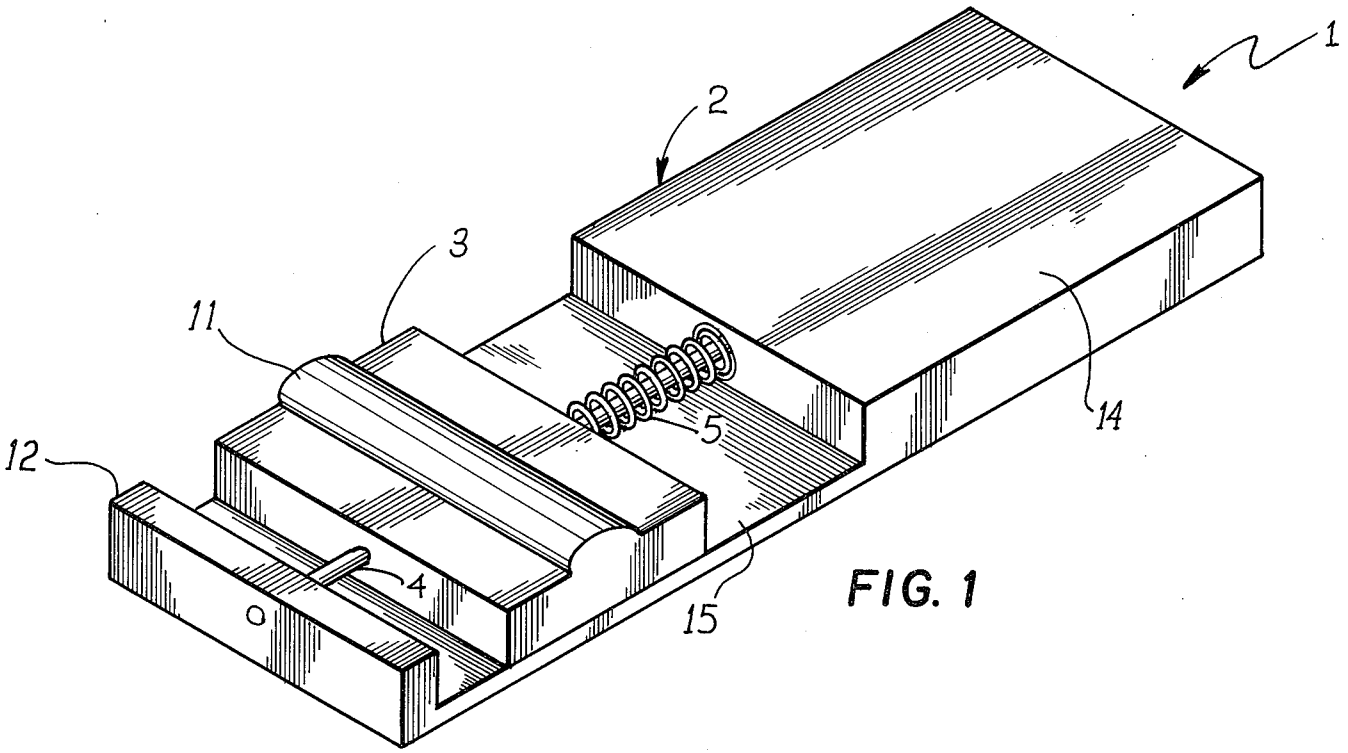
FIG. 1 is a perspective view of the metatarsal arch exerciser constructed in accordance with and embodying the present invention.

Referring now in more detail and by reference characters to the drawings which illustrate practical embodiments of the present invention, FIG. 1 is a perspective view of a metatarsal arch exerciser assembly.

As shown in FIG. 1, metatarsal arch exerciser assembly 1, comprises a housing portion 2, a sliding portion 3, a guiding rod portion 4 and a spring portion 5.

Figure 2:
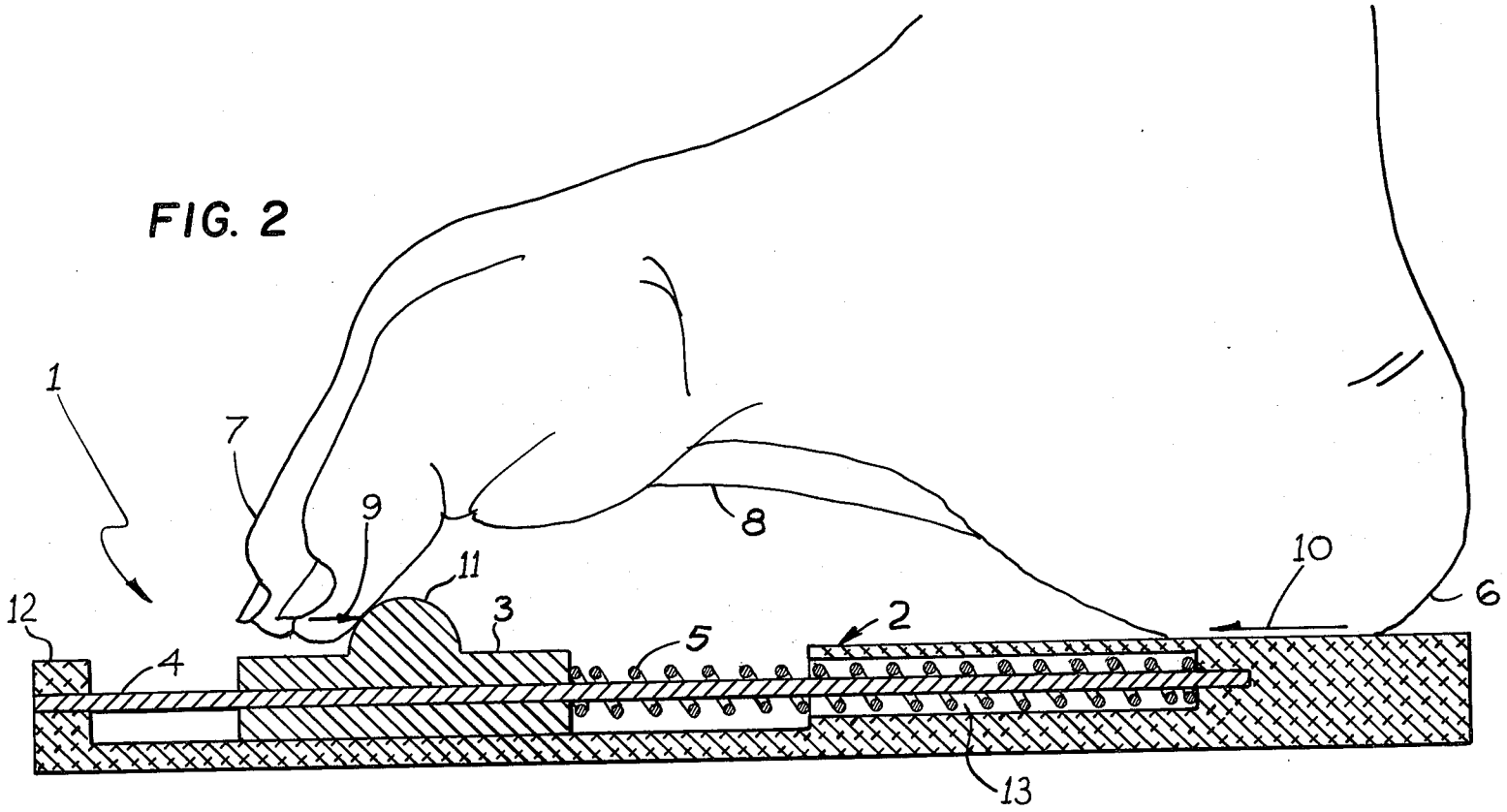
FIG. 2 is a cut view of the device in FIG. 1 while activated by a human's foot.

As shown in FIG. 2, housing portion 2 is capable of supporting a human heel 6 at one end and supporting a sliding toe engaging portion 3 at the other end. Said sliding portion 3 includes a transverse rib means 11 which is capable of being gripped by the toes 7 of a user. As the metatarsal arch 8 is flexed, opposing reaction 9 and frictional reaction 10 are developed, said reaction 9 and frictional reaction 10 will cause said sliding portion 3 to slide linearly along the recessed section 15 of the housing portion 2 and guiding rod portion 4 toward said human heel 6 compressing spring portion 5 between sliding portion 3 and the end wall of internal bore 13 in the housing portion 2.

The guide rod means 4 is attached at one end within bore 13 in the heel support portion 14 of the housing 2. It extends through the recessed section 15 and is secured at its opposite end to the flange 12. Said guiding rod 4 guides sliding portion 3 and supports spring portion 5. Said spring portion 5 is capable of being compressed by opposing force 9 and frictional force 10, said spring portion 5 will develope sufficient resistance to make the flexing of said metatarsal arch 8 strenuous, developing flexibility and strength of said metatarsal arch 8. Said sliding device 3 is capable of returning to its original position by the stored energy of said spring portion 5 as the flexion of said metatarsal arch 8 is relaxed. This procedure can be repeated as many times as desired without any interruptions.

This invention has been thoroughly tested and found to be completely satisfactory for the accomplishment of the above objects. While I have shown a preferred embodiment thereof, I wish it to be specifically understood that the same may be modified. For example, said housing can have built-in guiding means. Said spring can be any kind of recoil means such as a dead weight pulling a cable by the aid of a pulley, or said recoil means can be in tension located at the opposite end of said sliding means. Said recoil can be an air spring or various kinds of resilient material. Said gripping rib means means for the toes, and the support for the heel can be of numerous shapes.

It should be understood that changes and modifications in the form, construction, arrangement, and combination of the metatarsal arch exerciser and method of using the same may be made and substituted for those herein shown and described without departing from the nature and principle of my invention.

Having thus described my invention, what I claim is new and desire to secure by United States Letters Patent is:

1. A foot exerciser for the metatarsal arch comprising:

a housing having a rearward generally flat heel support surface, a forward upright flange and a central recessed slide support section, guide means extending between said heel support and said upright flange, a toe engaging member positioned in said central recessed slide support section slideably mounted on said guide means and including a raised transverse rib means adapted to be frictionally engaged by the underside of a user's toes, said toe engaging member being slideably mounted for linear movement toward and away from said heel support, and means biasing said toe engaging member away from said heel support member.

* * * * *